US007581631B2

(12) United States Patent
Aulanko et al.

(10) Patent No.: US 7,581,631 B2
(45) Date of Patent: Sep. 1, 2009

(54) TRAVELATOR, MOVING RAMP OR ESCALATOR

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 620 days.

(21) Appl. No.: 11/491,495

(22) Filed: Jul. 24, 2006

(65) Prior Publication Data

US 2009/0050443 A1 Feb. 26, 2009

Related U.S. Application Data

(63) Continuation of application No. PCT/FI2004/000814, filed on Dec. 31, 2004.

(30) Foreign Application Priority Data

Jan. 22, 2004 (FI) ..... 20040091

(51) Int. Cl.
*B66B 20/00* (2006.01)

(52) U.S. Cl. ..... 198/321

(58) Field of Classification Search ..... 198/321–338
See application file for complete search history.

(56) References Cited

U.S. PATENT DOCUMENTS

| | | | |
|---|---|---|---|
| 1,941,498 | A | 1/1934 | Shonnard |
| 2,766,868 | A | 10/1956 | Tilton |
| 3,321,059 | A | 5/1967 | Kroepel |
| 3,353,650 | A | 11/1967 | Schroeder et al. |
| 3,568,813 | A | 3/1971 | Schaeffer et al. |
| 3,749,224 | A | 7/1973 | Engeler |
| 3,835,977 | A | 9/1974 | Hewitt et al. |
| 3,981,118 | A | 9/1976 | Johnson et al. |
| 4,159,758 | A | 7/1979 | Courson |
| 4,232,776 | A | 11/1980 | Dean |
| 4,646,907 | A | 3/1987 | Streibig et al. |
| 4,662,502 | A | 5/1987 | Nakatani |
| 4,953,686 | A | 9/1990 | Rulke |
| 5,180,047 | A | 1/1993 | Barrett et al. |
| 5,215,177 | A | 6/1993 | Johnson et al. |
| 5,458,220 | A | 10/1995 | Nguyen et al. |
| 5,496,086 | A | 3/1996 | Adrian et al. |

(Continued)

FOREIGN PATENT DOCUMENTS

| | | | |
|---|---|---|---|
| EP | 066123 | A | 7/1995 |

(Continued)

OTHER PUBLICATIONS

Finnish Search Report issued in FI20040091 on Apr. 22, 2004.

(Continued)

*Primary Examiner*—Mark A Deuble
(74) *Attorney, Agent, or Firm*—Venable LLP; Robert Kinberg; Ryan M. Flandro

(57) ABSTRACT

A travelator, moving ramp or escalator for transporting passengers, comprises a conveyor mounted on a frame that is supported on a fixed structure. The frame comprises a number of mutually identical profiled metallic bodies joined together end to end one after the other and containing coupling, supporting and/or guide elements integrated in the profiled metallic body of solid material.

14 Claims, 4 Drawing Sheets

U.S. PATENT DOCUMENTS

| | | | | |
|---|---|---|---|---|
| 5,542,522 | A | 8/1996 | Adrian et al. | |
| 5,601,179 | A * | 2/1997 | Wente et al. | 198/335 |
| 5,782,333 | A | 7/1998 | Pitts | |
| 5,881,859 | A | 3/1999 | Bianchi | |
| 5,971,137 | A | 10/1999 | Grant et al. | |
| 6,223,879 | B1 | 5/2001 | Schops | |
| 6,374,981 | B1 | 4/2002 | Gschwendtner et al. | |
| 7,063,203 | B2 | 6/2006 | Gonzalez et al. | |
| 7,243,775 | B2 | 7/2007 | Novacek et al. | |
| 7,438,174 | B2 * | 10/2008 | Aulanko et al. | 198/321 |
| 7,441,644 | B2 * | 10/2008 | Aulanko et al. | 198/335 |
| 2002/0175039 | A1 | 11/2002 | Fargo et al. | |

FOREIGN PATENT DOCUMENTS

| | | |
|---|---|---|
| GB | 2 213 122 A | 8/1989 |
| JP | 11310378 | 11/1999 |
| JP | 2000-211871 | 8/2000 |
| JP | 2003212467 | 7/2003 |

OTHER PUBLICATIONS

International Search Report for PCT/FI2004/000814 Mailed Feb. 8, 2005.

International Search Report for PCT/FI2005/000013 Mailed Aug. 4, 2005.

* cited by examiner

TRAVELATOR, MOVING RAMP OR ESCALATOR

CROSS-REFERENCE TO RELATED APPLICATIONS

This application is a continuation of International Application No. PCT/FI2004/000814 filed Dec. 31, 2004, designating the United States and claiming priority from Application No. FI20040091 filed in Finland on Jan. 22, 2004, the disclosures of both applications being incorporated herein by reference along with each and every U.S. and foreign patent and patent application mentioned herein below. The subject matter of this application is also related to commonly owned and concurrently filed U.S. application No. 11/491,496.

BACKGROUND OF THE INVENTION

The invention relates to a travelator, moving ramp or escalator whereby people are transported on a conveyor in a horizontal direction or at an upward/downward angle. The conveyor is mounted on a frame which again is secured to a fixed structure, such as a floor in the case of a travelator, or to different floor levels in the case of a moving ramp or escalator.

As is known for example, from U.S. Pat. No. 4,811,829, the frame of an escalator is usually a rigid trussed construction welded together from beam elements, on which construction the guide tracks and other equipment required for the conveyor are mounted as separate parts. A problem with a frame structure constructed by welding is that it is very difficult to obtain a structure of exact dimensions. The assembly requires the use of expensive and complicated welding jigs. The frame is expensive and producing it is an expensive operation. In simplified terms, the load condition of a frame implemented as a trussed construction corresponds to the load condition of a double-supported beam supported by its ends. According such a frame has been designed to carry, with a certain safety margin, its own weight, the weight of the parts mounted on it and the weight of the passengers, which is why the frame is very heavy and difficult to handle. A trussed construction is usually very stiff and strong, but it is seldom optimized with respect to weight.

Further, European Patent document EP 1 321 424 A1 discloses a frame structure composed of planar frame plate elements. The elements have no profiled parts. The frame plate elements are provided with one or more openings. The openings are formed in the plates by a flame, plasma or laser cutting method. A problem with this frame structure is that its manufacture is time-consuming and expensive.

SUMMARY OF THE INVENTION

An object of the present invention is to overcome the above-mentioned drawbacks.

Another object of the invention is to provide a travelator, moving ramp or escalator that has an inexpensive frame and that can be manufactured at a low cost.

A further object of the invention is to provide a travelator, moving ramp or escalator that can be installed in its entire length on a load-bearing carrying structure without the frame itself having to bear any large loads.

The above and other objects are accomplished according to the invention wherein there is provided in an exemplary embodiment a travelator, moving ramp or escalator for transporting passengers, comprising: a frame adapted to be supported on a fixed structure; and a conveyor mounted on the frame; wherein the frame comprises two elongated frame parts, each frame part comprising a number of profiled metallic bodies of solid material joined together one after the other, each profiled metallic body including: coupling, supporting and/or guide elements integrated in the profiled metallic body; and an integrated wall forming an outwardly visible outer surface of each frame part.

According to the invention, the frame comprises a number of profiled metallic bodies preferably mutually identical in cross-section and successively connected to each other, said profiled bodies having coupling, supporting and/or guide elements integrated with the aforesaid one profiled metallic body of solid material.

The invention has the advantage that the frame structure formed from profiled metallic bodies is inexpensive and its manufacturing costs are low. Elements having different functions can be integrated in the shapes of one and the same profiled body. A very light frame structure of low construction can be achieved as the frame is mounted in its entire length on a fixed base.

In an exemplary embodiment of the invention, the frame comprises two elongated frame parts provided with guide tracks for guiding the conveyor and consisting of aforesaid profiled metallic bodies or similar bodies connected together end to end one after the other. In addition, a number of transverse cross members extend transversely between the frame parts to hold them parallel to each other at a distance from each other.

In another exemplary embodiment of the invention, the profiled metallic body consists of one or more profiles extruded from a light alloy, such as aluminum or an aluminum alloy.

In yet another exemplary embodiment of the invention, the conveyor is a pallet conveyor comprising a plurality of successive pallets and a drive element, such as a link chain or belt, to which the pallets are connected to move the pallets, the drive element being arranged as an endless loop having an upper portion and a lower portion.

In a further exemplary embodiment of the invention, the travelator, moving ramp or escalator comprises a handrail which itself comprises a handrail frame and an endless handrail belt supported on the handrail frame and arranged as a loop having an upper handhold portion that the passenger can grip with a hand for support and a lower return portion disposed inside the frame part.

In another exemplary embodiment of the invention, the travelator, moving ramp or escalator comprises a number of suspenders connected to the profiled metallic body at a distance from each other to support the return portion of the handrail belt.

In yet another exemplary embodiment of the invention, the handrail belt is in cross-section a substantially C-shaped profile, defining inside it an interior groove which in the return portion of the handrail belt opens upwards and which has at its edges edge flanges directed towards each other, with a gap between them. The suspender comprises a web extending through the gap of the handrail belt into the interior groove and suspension flanges extending on either side of the web under the edge flanges to support the handrail belt.

In one exemplary embodiment of the invention, the suspender comprises one or more coupling elements for securing a conductor.

In a further exemplary embodiment of the invention, the suspender has been formed from a material that has a substantially low friction coefficient.

In an embodiment of the invention, the contact surfaces of the edge flanges of the handrail belt that come into contact with the suspension flanges are coated with a material that has a substantially low friction coefficient.

In another exemplary embodiment of the invention, one profiled metallic body of continuous material contains one or more items of the following group integrated in it:

a wall forming the outwardly visible outer surface of the frame part;

a bottom fitted to be resting against a fixed base, first stop faces for forming a guide surface for supporting and guiding the pallets;

second stop faces, against which the handrail frame can be supported;

a mounting slot for a fastening element for securing the handrail frame;

a first coupling element for securing the suspender, a second coupling element for coupling a second profiled body, such as a profiled body forming an interior wall, from a lateral direction;

a first space, which has been fitted to receive inside it the return portion of the handrail belt;

a second space, which has been fitted to receive inside it the upper portion of the drive element;

a third space, which has been fitted to receive inside it the lower portion of the drive element;

a fourth space, which has been fitted to receive inside it an extension joint element for joining the profiled metallic bodies end to end one after the other;

a fifth space, which has been fitted to receive inside it an alignment pin for butt alignment of the profiled metallic bodies.

In yet another exemplary embodiment of the invention, the travelator, moving ramp or escalator is a travelator, moving ramp or escalator of low construction height designed to be mounted on a fixed base, such as a floor or other support.

DETAILED DESCRIPTION OF AN EXEMPLARY EMBODIMENT

Figure 1:
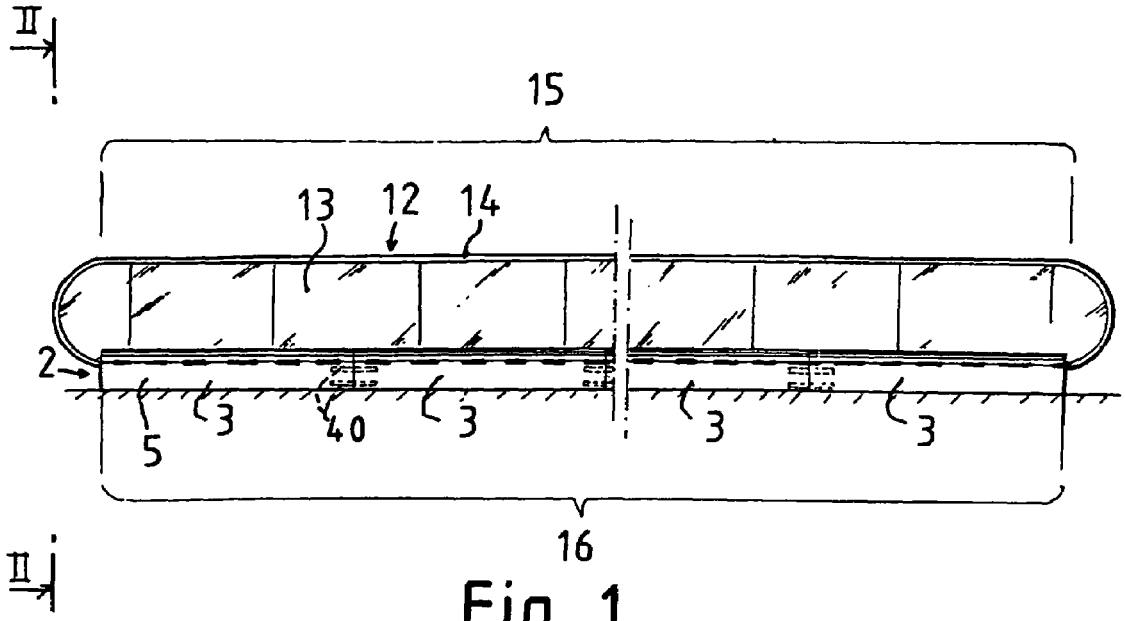
FIG. 1 presents a diagrammatic side view of an embodiment of the travelator of the invention.
Figure 2:
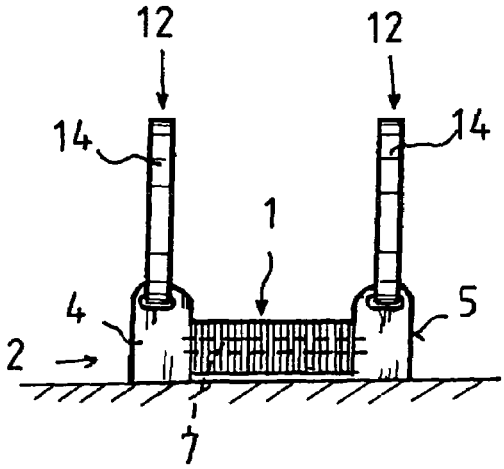
FIG. 2 presents the travelator of FIG. 1 as seen from direction II-II.

FIGS. 1 and 2 present a travelator of low construction height, designed to be mounted on a fixed base, such as a floor or other support, which means that no pit needs to be made in the fixed base for the travelator machinery. In the following description of an exemplary embodiment, the invention is described with reference to a horizontal travelator, but it is obvious that corresponding principles of the invention can also be applied to moving ramps and escalators.

The travelator comprises a conveyor 1, which may be for example, a pallet conveyor or a belt conveyor, which is supported on a frame 2. The entire length of the frame 2 rests on a floor base. As shown in FIG. 2, the frame 2 comprises two elongated frame parts 4, 5, which are connected together by a number of transverse cross members 7 extending transversely between the frame parts 4, 5 to hold them parallel to each other at a distance from each other. The frame parts 4, 5 are composed of mutually identical profiled metallic bodies 3 joined together end to end one after the other, which contain guide elements 6 integrated in one profile of solid material for guiding the coupling, supporting and/or moving parts of the conveyor, as will be described later on with reference to FIGS. 3 and 4.

As is further shown in FIGS. 1 and 2, the travelator comprises two handrails 12, one on either side of the conveyor 1. The handrails 12 comprise a handrail frame 13, which is secured to the profiled metallic bodies 3 serving as frame parts 4, 5. Mounted on the handrail frame 13 is an endless handrail belt 14, which has been arranged as a loop having an upper handhold portion 15 that the passenger can grip with a hand for support and a lower return portion 16 disposed inside the frame part 4, 5.

Figure 3:
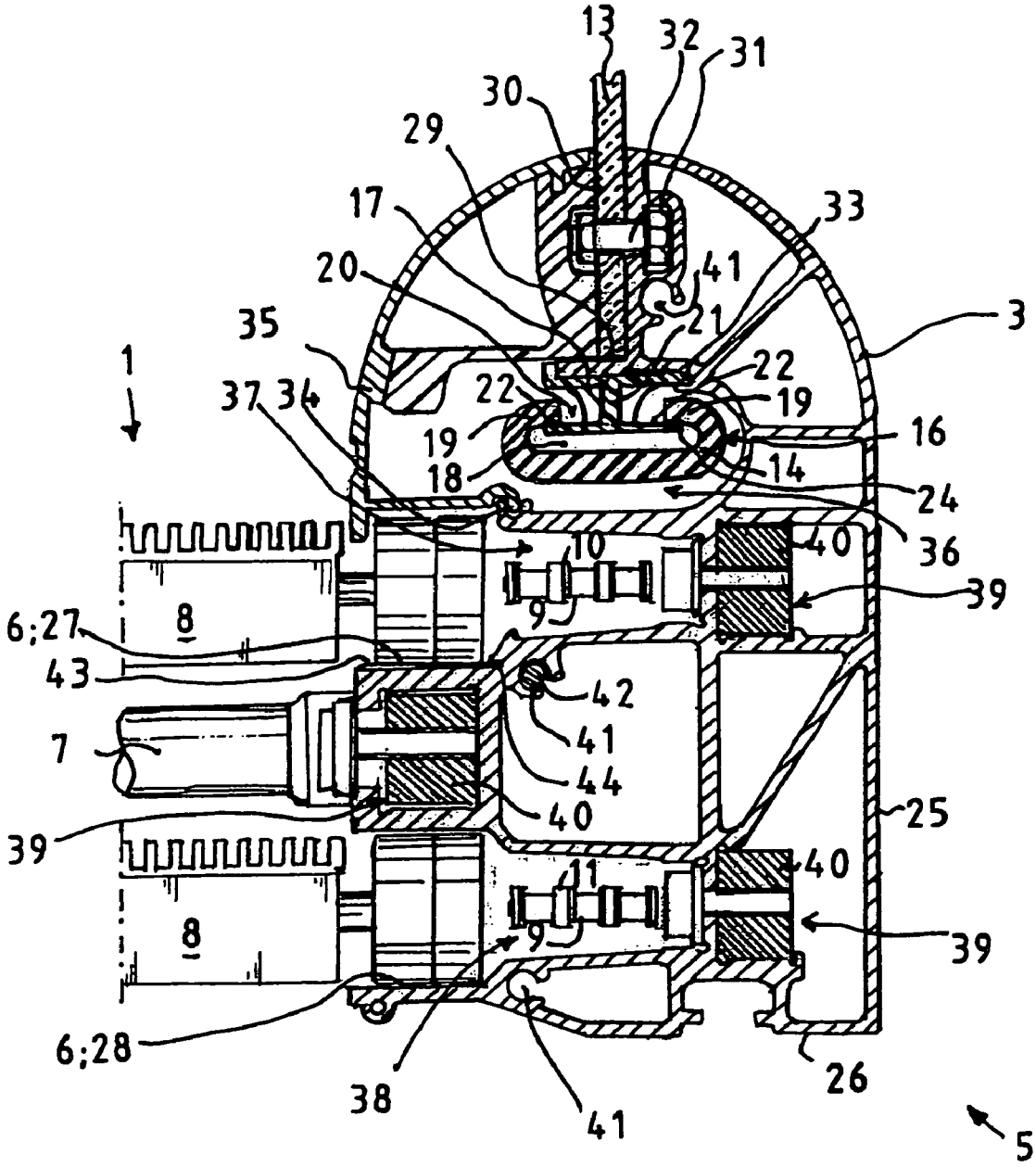
FIG. 3 presents a cross-sectional view of a part of the travelator in FIG. 1.

FIG. 3 is a diagrammatic view of one side of the conveyor 1. The other side, which is not shown in the figures, is identical but reversed like a mirror image. It can be seen from the figure that the conveyor 1 is a pallet conveyor comprising a number of pallets 8 arranged one after the other. In this case, the drive element 9 used to move the pallets is a link chain, to which the pallets 8 are secured to move them. The drive element 9 has been implemented as an endless loop, which extends perpendicularly to the plane of the figure and of which the figure shows the upper portion 10 and the lower portion 11. The pallet 8 shown at a higher level is a pallet moving in the transport direction. The pallet 8 shown at a lower level is a pallet moving in the opposite direction, returning to the beginning of the conveyor track.

The profiled metallic body 3, of which the frame parts 4 and 5 are composed, consists of a profile extruded from a light metal, preferably aluminum or an aluminum alloy, containing many functions integrated in one body. The low construction height is exemplified by the fact that in one embodiment the height of the profile is about 34 cm.

As shown in FIG. 3, the handrail belt 14 is supported by suspenders 17, one of which is seen in the figure, which are fastened to the profiled metallic body 3 at a distance from each other to support the return portion 16 of the handrail belt 14. The handrail belt 14 is a substantially C-shaped profile in cross-section such that it defines inside it an interior groove 18 which, in the return portion 16 of the handrail belt, opens upwards. At the edges of the interior groove 18 are edge flanges 19 directed towards each other, with a gap 20 between them.

It can be seen from the FIG. 3 that the web 21 of the suspender 17 extends through the gap 20 of the handrail belt into the interior groove 18. The suspension flanges 22 extend under the edge flanges 24 on either side of the web 21, thus supporting the handrail belt 14.

Figure 5:
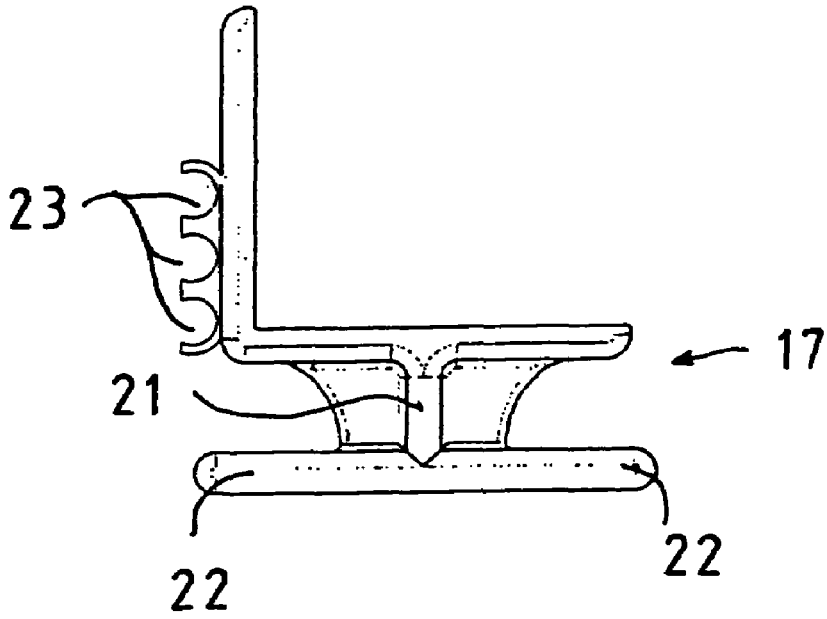
FIG. 5 presents a suspender that can be joined to the profile of the frame part 3 in FIG. 3.
Figure 6:
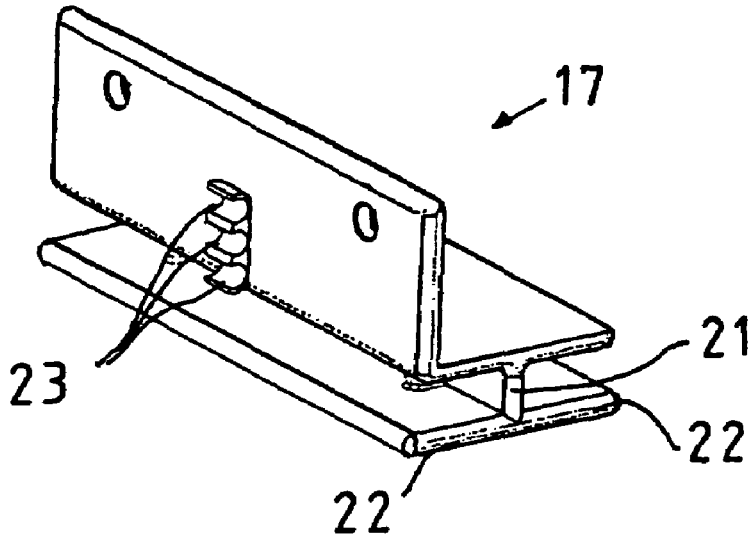
FIG. 6 presents an axonometric view of the suspender in FIG. 5.

From FIGS. 5 and 6 it can see that the suspender 17 comprises a vertical mounting flange whereby the suspender 17 can be fastened with a screw joint to the profiled body 3. The mounting flange has three snap-on coupling elements 23 formed on it for the attachment of conductors. The suspender 17 is preferably a single solid piece extruded from plastic. To allow the handrail belt to slide with low friction on the suspenders, the suspender 17 is formed from a plastic material having a substantially low friction coefficient. Similarly, the contact surfaces 24 of the edge flanges 19 of the handrail belt 14 that come into contact with the suspension flanges 22 may be coated with a material having a substantially low friction coefficient.

Figure 4:
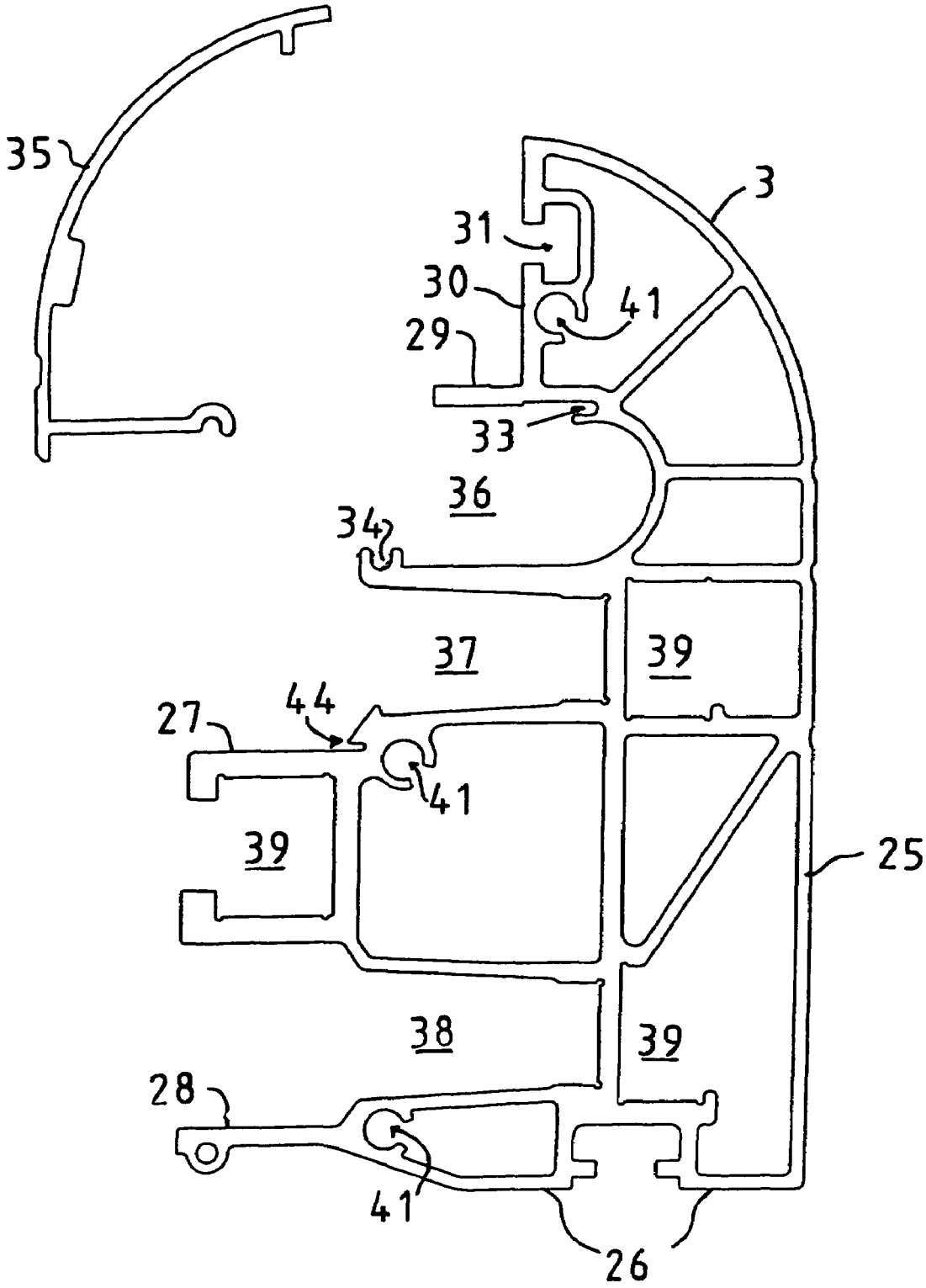
FIG. 4 presents the profile of the frame part in FIG. 3 and a covering profile that can be attached to it.

As can be seen from FIGS. 3 and 4, integrated in the single profiled metallic body of solid material is a wall 25 forming the outwardly visible outer surface of the frame part 4, 5 and a bottom 26 fitted to be resting against a fixed base. Further, the profiled body 3 has first stop faces 27, 28 for forming a guide track 6 for supporting and guiding the pallets 8. The upper stop face 27 supports the wheels of loaded pallets 8. The whole or part of the length of the upper stop face 27 can be covered with a wearing plate 43, such as a sheet steel plate, which can be fastened in place in a groove 44 formed in the profiled metallic body. Such a sheet steel plate 43 is preferably provided at least at the joints between profiled metallic bodies 3 to eliminate any discontinuities of the stop face that may arise due to inaccurate alignment. Further, integrated in the profiled metallic body 3 are second stop faces 29, 30, which are a horizontal stop face 29, on which the edge of the handrail frame plate 13 can be supported, and a vertical stop face 30, against which the edge of the handrail frame plate 13 can be rested. Formed in the profiled body 3 is also a mounting slot 31 for a retaining bolt 32 used to secure the handrail frame 13, which slot can receive the head of the bolt 32 inside it. The profiled metallic body 3 further has a groove integrated in it as a coupling element 33 for fastening the suspender 17. In addition, it has a second coupling element 34 for joining a second profiled body 35 forming an interior wall to the profiled metallic body 3 from a lateral direction. Further, the profiled metallic body 3 contains a first space 36, which has been fitted to receive the return portion 16 of the handrail belt 14 inside it. Moreover, the profiled metallic body 3 contains a second space 37, which has been fitted to receive the upper portion 10 of the drive element 9 inside it. A third space 38 has been fitted to receive the lower portion 11 of the drive element 9 inside it. Furthermore, the profiled metallic body 3 contains three fourth spaces 39, which have been fitted to receive inside them a bar-like extension joint element 40 for joining the profiled metallic bodies 3 end to end one after the other. In addition, the profiled metallic body 3 contains three fifth spaces 41, which have been fitted to receive inside them round alignment pins 42, by means of which the profiled metallic bodies 3 can be accurately aligned relative to each other.

The invention is not limited to the embodiment examples described above; instead, many variations are possible within the scope of the inventive concept defined in the claims.

What is claimed is:

1. A travelator, moving ramp or escalator for transporting passengers, comprising:

a frame adapted to be supported on a fixed structure; and a conveyor mounted on the frame;

wherein the frame comprises two elongated frame parts, each frame part comprising a number of profiled metallic bodies of solid material joined together one after the other, each profiled metallic body including:

coupling, supporting and/or guide elements integrated in the profiled metallic body; and an integrated wall forming an outwardly visible outer surface of each frame part.

2. The travelator, moving ramp or escalator according to claim 1, wherein each of the two elongated frame parts include guide tracks for guiding the conveyor, wherein the frame parts are formed from the profiled metallic bodies joined together one after the other; and the frame further includes a number of transverse members extending transversely between the frame parts to hold the frame parts parallel to each other at a distance from each other.

3. The travelator, moving ramp or escalator according to claim 2, wherein each profiled metallic body comprises one or more profiles extruded from a light metal.

4. The travelator, moving ramp or escalator according to claim 3, wherein the light metal comprises at least one of aluminum or an aluminum alloy.

5. The travelator, moving ramp or escalator according to claim 1, wherein the conveyor comprises a pallet conveyor including a number of successive pallets and a drive element to which the pallets are secured to move the pallets, the drive element being arranged as an endless loop having an upper portion and a lower portion.

6. The travelator, moving ramp or escalator according to claim 5, wherein the endless loop comprise one of a link chain or a belt.

7. The travelator, moving ramp or escalator according to claim 1, further comprising a handrail, the handrail including a handrail frame and an endless handrail belt, the handrail belt comprising a loop having an upper handhold portion that a passenger can grip with a hand for support and a lower return portion disposed inside one of the frame parts.

8. The travelator, moving ramp or escalator according to claim 7, further comprising a number of suspenders fastened to the profiled metallic body at a distance from each other to support the return portion of the handrail belt.

9. The travelator, moving ramp or escalator according to claim 8, wherein the handrail belt has a cross-section with a substantially C-shaped profile defining an interior groove which in the return portion of the handrail belt opens upwards and has edge flanges directed towards each other, with a gap between the edge flanges; and wherein the suspender comprises a web extending through the gap of the handrail belt into the interior groove and suspension flanges extending on either side of the web under the edge flanges to support the handrail belt.

10. The travelator, moving ramp or escalator according to claim 9, wherein the suspender comprises one or more coupling elements for securing a conductor.

11. The travelator, moving ramp or escalator according to claim 8, wherein the suspender comprises a material having a substantially low friction coefficient.

12. The travelator, moving ramp or escalator according to claim 9, wherein the edge flanges of the handrail belt have contact surfaces that come into contact with the suspension flanges and which are coated with a material having a substantially low friction coefficient.

13. The travelator, moving ramp or escalator according to claim 8, wherein the coupling, supporting and/or guide elements integrated into each profiled metallic body include at least one of the following integrated elements:

a bottom fitted to be resting against the fixed base;

first stop faces for forming a guide track for supporting and guiding the pallets of the conveyor;

second stop faces against which the handrail frame can be supported;

a mounting slot for a fastening element for securing the handrail frame;

a first coupling element for securing the suspenders;

a second coupling element for joining a second profiled body such as a profiled body forming an interior wall, from a lateral direction, a third coupling element for fastening a wearing plate on a stop face;

a first space fitted to receive a return portion of the handrail belt;

second space fitted to receive an upper portion of a drive element;

a third space fitted to receive a lower portion of a drive element;

a fourth space fitted to receive an extension joint element for joining the profiled metallic bodies end to end one after the other;

a fifth space fitted to receive an alignment pin for butt alignment of the profiled metallic bodies.

14. The travelator, moving ramp or escalator according to claim 1, wherein the travelator, moving ramp or escalator is of a low construction height and adapted to be mounted upon a fixed base, such as a floor or other support.

* * * * *

UNITED STATES PATENT AND TRADEMARK OFFICE

CERTIFICATE OF CORRECTION

PATENT NO. : 7,581,631 B2
APPLICATION NO. : 11/491495
DATED : September 1, 2009
INVENTOR(S) : Aulanko et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 659 days.

Signed and Sealed this

Fourteenth Day of September, 2010

David J. Kappos

David J. Kappos
*Director of the United States Patent and Trademark Office*